United States Patent [19]

Kenkare et al.

[11] 4,116,354

[45] Sep. 26, 1978

[54] TWO CHAMBERED MIXING CONTAINER

[75] Inventors: Divaker B. Kenkare, South Plainfield; Robert T. Hall, II, Trenton; John C. Carson, Jr., Manasquan Park, all of N.J.

[73] Assignee: Colgate-Palmolive Company, New York, N.Y.

[21] Appl. No.: 761,845

[22] Filed: Jan. 24, 1977

[51] Int. Cl.[2] ..... B65D 1/24

[52] U.S. Cl. ..... 220/20; 206/219; 222/188

[58] Field of Search ..... 222/94, 378, 379, 523, 222/188, 541; 259/48, 54; 206/219, 221; 220/93, 8, 20, 20.5, 282.5; 128/218 M, DIG. 28, 220

[56] References Cited

U.S. PATENT DOCUMENTS

| | | | |
|---|---|---|---|
| 3,279,654 | 10/1966 | Pievick | 128/220 X |
| 3,477,431 | 11/1969 | Walecka | 128/DIG. 28 |
| 3,595,439 | 7/1971 | Newby et al. | 206/219 X |
| 3,722,512 | 3/1973 | Hein et al. | 128/220 |
| 3,762,540 | 10/1973 | Bauman et al. | 206/219 |

*Primary Examiner*—Joseph F. Peters, Jr.
*Assistant Examiner*—Norman L. Stack, Jr.
*Attorney, Agent, or Firm*—Kenneth A. Koch; Herbert S. Sylvester; Murray M. Grill

[57] ABSTRACT

A mixing container comprising first and second cylindrical containers telescopically arranged. One form of the invention includes an upwardly extending channel in the side walls of the upper container together with an upper opening therein for permitting mixing of ingredients. Another form of the invention conceives of a rupturable membrane closing an opening in the bottom wall of the upper container. The upper container is provided with a ventable top closure.

3 Claims, 4 Drawing Figures

FIG. 1
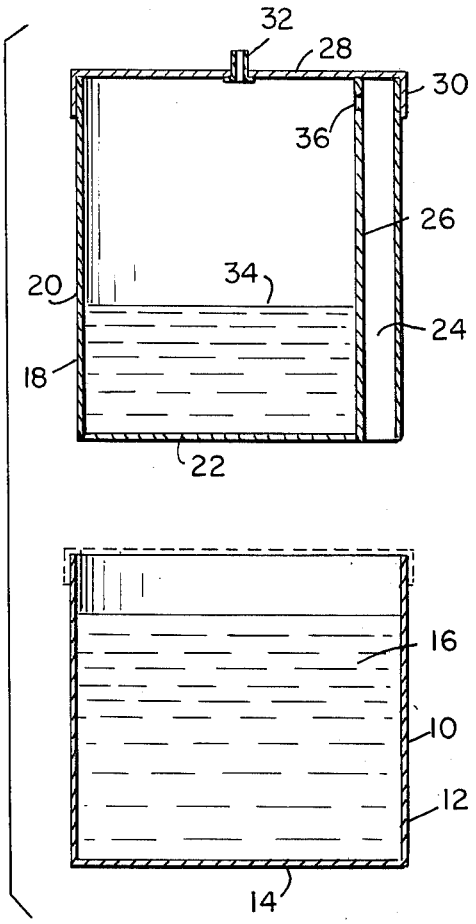
FIG. 2
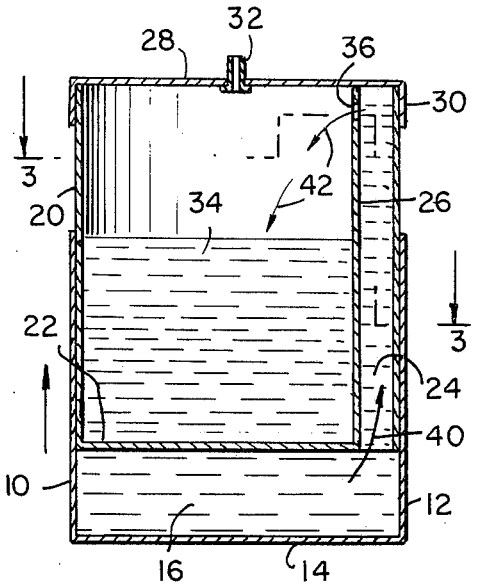
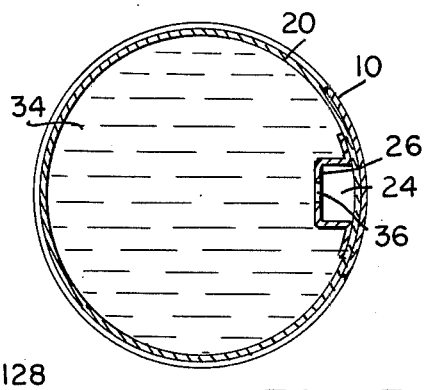
FIG. 3
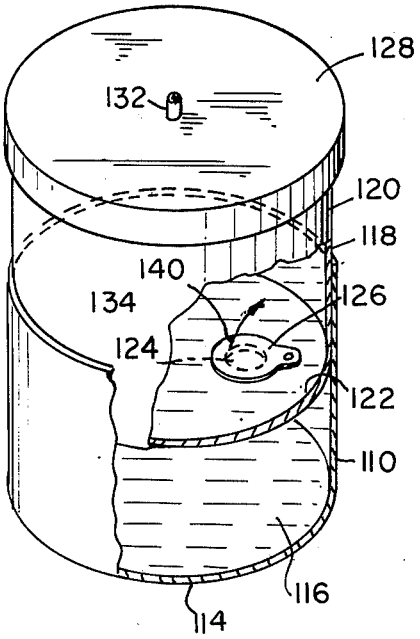
FIG. 4

TWO CHAMBERED MIXING CONTAINER

BACKGROUND OF THE INVENTION

1. Field of the Invention

This invention relates to a two chambered dispenser for mixing reactive materials.

2. Description of the Prior Art

In the past various reactive materials such as hair dyes, cosmetics, adhesives, and pharmaceuticals which must be separated until used have been packaged in wholly separate containers such as bottles or the like which are poured one into the other for reaction prior to use. Various types of two container applicators and dispensers have been devised in the past but these devices have required mechanisms for breaking or opening one of the containers. Since slight movement of one container relative to the other will cause mixing in these packages such are unsafe for transportation and normal handling.

Further, in prior packages mixing of the two reactive material sometimes involves physically removing one or both components from the container prior mixing. These manipulations may involve a degree of risk of injury or staining to the user especially if one or both components are hazardous.

SUMMARY OF THE INVENTION

The concept of the present invention resides in utilizing a pair of telescoping containers provided with means for mixing of materials only after a very definite movement of one container relative to the other thus inhibiting accidental mixing.

It is therefore an object of the invention to provide a two chambered dispenser which will keep separate two reactive constituants to enhance shelf life.

It is a further object of the invention to provide a dispenser which facilitates mixing constituents immediately prior to use.

Yet another object is to provide a device of the type which will afford the convenient dispensing of a resultant mixture.

These, together with the various ancillary objects of the invention, which will become apparent as the further description proceeds, are attained by this two chambered dispenser, preferred embodiments of which are illustrated in the accompanying drawings.

BRIEF DESCRIPTION OF DRAWING

FIG. 1 is a vertical exploded sectional view of an embodiment of the invention;

FIG. 2 is a vertical sectional view of the invention shown in an intermediate stage of mixing;

FIG. 3 is a horizontal sectional view taken along lines 3—3 in FIG. 2; and FIG. 4 is a perspective view with parts broken away of another embodiment of the invention.

DETAILED DESCRIPTION OF THE INVENTION

With continuing reference to the accompanying drawing, wherein like reference numerals designate similar parts throughout the various views, reference numeral 10 generally designates a lower first container having cylindrical side walls 12 and a bottom 14. The container 10 is filled to a predetermined degree with a first substance 16.

A second container 18 having cylindrical side walls 20 and bottom 22 is telescopingly seated in the first container 10. The side walls 20 have a passageway therein defined by a channel shaped depression 26. A top 28 having a peripheral flange 30 provides a closure for the dispenser and is vented at 32.

The depression 26 is provided with an opening 36 at its uppermost portion and the container 18 is partially filled with a second substance 34.

In use, the packaged substances 16 and 34 remain separate until the containers are strongly and continuously pushed telescopically together. This causes the substance 16 to move upwardly to the direction of arrow 40 through the passageway 24 and through opening 36 in the direction of arrow 42 to permit mixing of the fluid substances of whatever viscosities selected.

In FIG. 4 there is shown an alternative form of the invention. Container 110 is identical with container 10 and has a first substance 116 therein, Container 118 has cylindrical side walls 120 and a bottom 122 provided with an opening 124 covered and closed by a rupturable membrane past which the substance 116 can travel in the direction of arrow 140 to mix with substance 134. A vented cover 128 is provided.

What we claim as new is:

1. A mixing container comprising a first container defining a first chamber for receiving a first substance, a second container adapted to telescopingly fit within said first chamber and defining a second chamber for receiving a second substance, and means for communicating said first and second chambers to allow mixing of the first and second substances when said second container is pushed into said first container, said means including an upwardly extending channel shaped groove provided in the side wall of said second container and an opening through said side wall communicating with said first chamber and disposed at the upper part of said groove.

2. A mixing container according to claim 1 wherein each of said containers include cylindrical side walls, a bottom wall, and a top for closing said second container.

3. A mixing container according to claim 2, wherein said top has an exhaust vent therein.

* * * * *